US009750346B2

(12) United States Patent
Chen et al.

(10) Patent No.: US 9,750,346 B2
(45) Date of Patent: Sep. 5, 2017

(54) DRAWER SLIDE ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Fang-Cheng Su, Kaohsiung (TW); Shih-Lung Huang, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/202,808

(22) Filed: Jul. 6, 2016

(65) Prior Publication Data

US 2017/0135475 A1 May 18, 2017

(30) Foreign Application Priority Data

Nov. 12, 2015 (TW) ..... 104137457 A

(51) Int. Cl.

| | |
|---|---|
| ***A47B 88/00*** | (2017.01) |
| ***A47B 88/04*** | (2006.01) |
| ***A47B 88/08*** | (2006.01) |

(52) U.S. Cl.

CPC ..... *A47B 88/0407* (2013.01); *A47B 88/044* (2013.01); *A47B 88/08* (2013.01); *A47B 2210/0056* (2013.01)

(58) Field of Classification Search

CPC ..... A47B 88/0407; A47B 88/044; A47B 2210/0056

See application file for complete search history.

(56) References Cited

U.S. PATENT DOCUMENTS

| | | | | |
|---|---|---|---|---|
| 5,439,283 | A | 8/1995 | Schroder et al. | |
| 5,664,855 | A | 9/1997 | Lautenschlager et al. | |
| 7,226,139 | B2 | 6/2007 | Salice | |
| 7,857,404 | B2 * | 12/2010 | Lam | A47B 88/0014 312/263 |
| 9,039,108 | B2 | 5/2015 | Feuerstein | |
| 2001/0019235 | A1 * | 9/2001 | Hammerle | A47B 88/0407 312/334.4 |
| 2004/0119387 | A1 * | 6/2004 | Schwaerzler | A47B 88/0055 312/334.4 |
| 2007/0138924 | A1 * | 6/2007 | Lautenschlager | A47B 88/0055 312/348.2 |
| 2008/0247812 | A1 * | 10/2008 | Embacher | A47B 88/0477 403/231 |
| 2009/0174299 | A1 * | 7/2009 | Lam | A47B 88/0055 312/348.4 |

(Continued)

*Primary Examiner* — Hanh V Tran

(74) *Attorney, Agent, or Firm* — Rosenberg, Klein & Lee

(57) ABSTRACT

A drawer slide assembly includes a first rail, a second rail, a drawer frame member, and an adjusting device. The second rail can be displaced with respect to the first rail along a longitudinal direction. The drawer frame member includes a carrier and a drawer sidewall connected to the carrier. The carrier is mounted on the second rail. The adjusting device is mounted on the drawer sidewall and is configured to adjust the drawer frame member vertically with respect to the second rail.

15 Claims, 10 Drawing Sheets

(56) References Cited

U.S. PATENT DOCUMENTS

| | | | | |
|---|---|---|---|---|
| 2010/0102692 | A1* | 4/2010 | Hammerle | A47B 88/0055 312/348.4 |
| 2012/0286116 | A1* | 11/2012 | Gasser | A47B 88/0055 248/221.11 |
| 2014/0015391 | A1* | 1/2014 | Feuerstein | A47B 88/0055 312/334.4 |

* cited by examiner

DRAWER SLIDE ASSEMBLY

FIELD OF THE INVENTION

The present invention relates to a drawer slide assembly which includes an adjusting device to facilitate vertical adjustment of the mounting position of a drawer frame member with respect to a slide assembly.

BACKGROUND OF THE INVENTION

A plurality of drawers and/or laminated boards can be put together only to form an esthetically compromised product due to the manufacturing and assembly tolerances of each of the aforesaid components. To prevent this from happening, an adjusting device is required to fine-tune the vertical position of each drawer and/or laminated board. For example, U.S. Pat. No. 9,039,108 B2, granted to Feuerstein, discloses the structure of a drawer height adjusting device. According to the disclosure of this patent, the rear wall holder 10 of the drawer frame member 1 includes an adjusting device 2, which has an actuating element 4 corresponding to the interior of the drawer frame. A user can rotate the actuating element 4 from inside the drawer frame to adjust the vertical position of the drawer or a laminated board. The rear wall holder 10 and the adjusting device 2, however, are modular components which cannot be used or replaced individually.

SUMMARY OF THE INVENTION

The present invention relates to a drawer slide assembly which allows a drawer frame member to be adjusted vertically with respect to a slide assembly in an easy manner.

According to one aspect of the present invention, a drawer slide assembly includes a first rail, a second rail, a drawer frame member, and an adjusting device. The second rail can be displaced longitudinally with respect to the first rail. The drawer frame member includes a carrier and a drawer sidewall connected to the carrier. The carrier is mounted on the second rail. The adjusting device is mounted on the drawer sidewall and is configured to adjust the drawer frame member vertically with respect to the second rail.

Preferably, the drawer sidewall includes a front end portion and a rear end portion respectively connected to a front panel and a rear panel, and the adjusting device is mounted on the drawer sidewall at a position adjacent to the rear end portion of the drawer sidewall.

Preferably, the carrier is provided with an opening corresponding to the second rail, the adjusting device includes a moving member. A portion of the moving member extends through the opening so that, when the moving member is displaced with respect to the housing by rotating the cam, the portion of the moving member can be pressed against the second rail.

Preferably, the adjusting device includes a housing, a moving member, and a cam. The housing is mounted on the drawer sidewall. The moving member has a pressing portion. At least a portion of the cam is pressed against the pressing portion of the moving member such that, by rotating the cam, the moving member is displaced with respect to the housing.

Preferably, the cam has a C-shaped groove, and at least a portion of the pressing portion extends into the C-shaped groove.

Preferably, at least one of the moving member and the housing has a guiding portion, and the moving member is guided by the guiding portion when displaced with respect to the housing. In some embodiments, the guiding portion is extended from the moving member, and the housing is formed with a guide groove, in which the guiding portion of the moving member is located.

Preferably, the housing of the adjusting device includes two supporting bases, each of the two supporting bases has a pivot hole. The cam of the adjusting device has a shaft portion pivotally provided in the pivot holes of the two supporting bases.

Preferably, the shaft portion of the cam has an engaging groove, and a corresponding tool, e.g., a screwdriver, can be inserted into the engaging groove to rotate the cam.

Preferably, the drawer sidewall includes two plates, a receiving space is defined between the two plates, and the adjusting device is located in the receiving space.

According to another aspect of the present invention, an adjusting device applicable to furniture includes a housing, a moving member, and a cam. The housing includes two supporting bases each having a pivot hole. The moving member can be displaced with respect to the housing and has a pressing portion. The cam has a shaft portion pivotally provided in the pivot holes of the two supporting bases. At least a portion of the cam is pressed against the pressing portion of the moving member such that the moving member can be displaced with respect to the housing by rotating the cam.

Preferably, the moving member is extended with a guiding portion, the housing is formed with a guide groove, and the guiding portion extends through the guide groove such that the moving member is guided by the guide groove when displaced with respect to the housing.

One of the advantageous features of the present invention is that the drawer slide assembly includes an adjusting device which facilitates vertical adjustment of a drawer frame member with respect to a slide assembly.

DETAILED DESCRIPTION OF THE INVENTION

Figure 1:
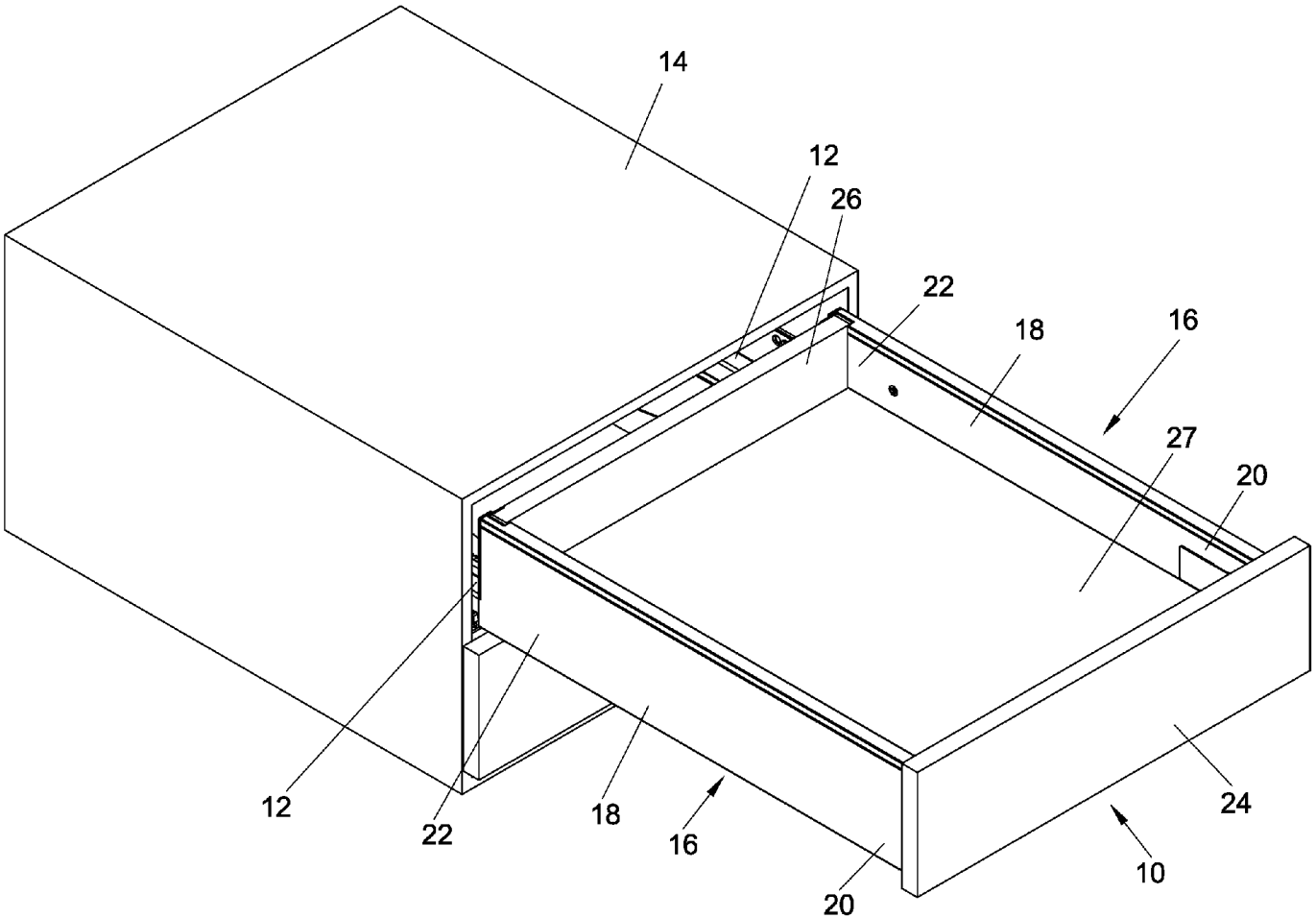
FIG. 1 is a perspective view showing how a drawer in an embodiment of the present invention is mounted to a cabinet via a pair of slide assemblies.

Referring to FIG. 1, a drawer 10 in an embodiment of the present invention is mounted to a cabinet 14 by a pair of slide assemblies 12 so as to be pulled out of and pushed back into the cabinet 14 smoothly. The drawer 10 includes a pair of drawer frame members 16. Each drawer frame member 16 includes a drawer sidewall 18, and each drawer sidewall 18 has a front end portion 20 and a rear end portion 22. The front end portions 20 of the drawer sidewalls 18 of the pair of drawer frame members 16 are connected to a front panel 24 while the rear end portions 22 of the drawer sidewalls 18 of the pair of drawer frame members 16 are connected to a rear panel 26. The pair of drawer sidewalls 18, the front panel 24, and the rear panel 26 are connected to a drawer bottom panel 27 to form the drawer 10.

Figure 2:
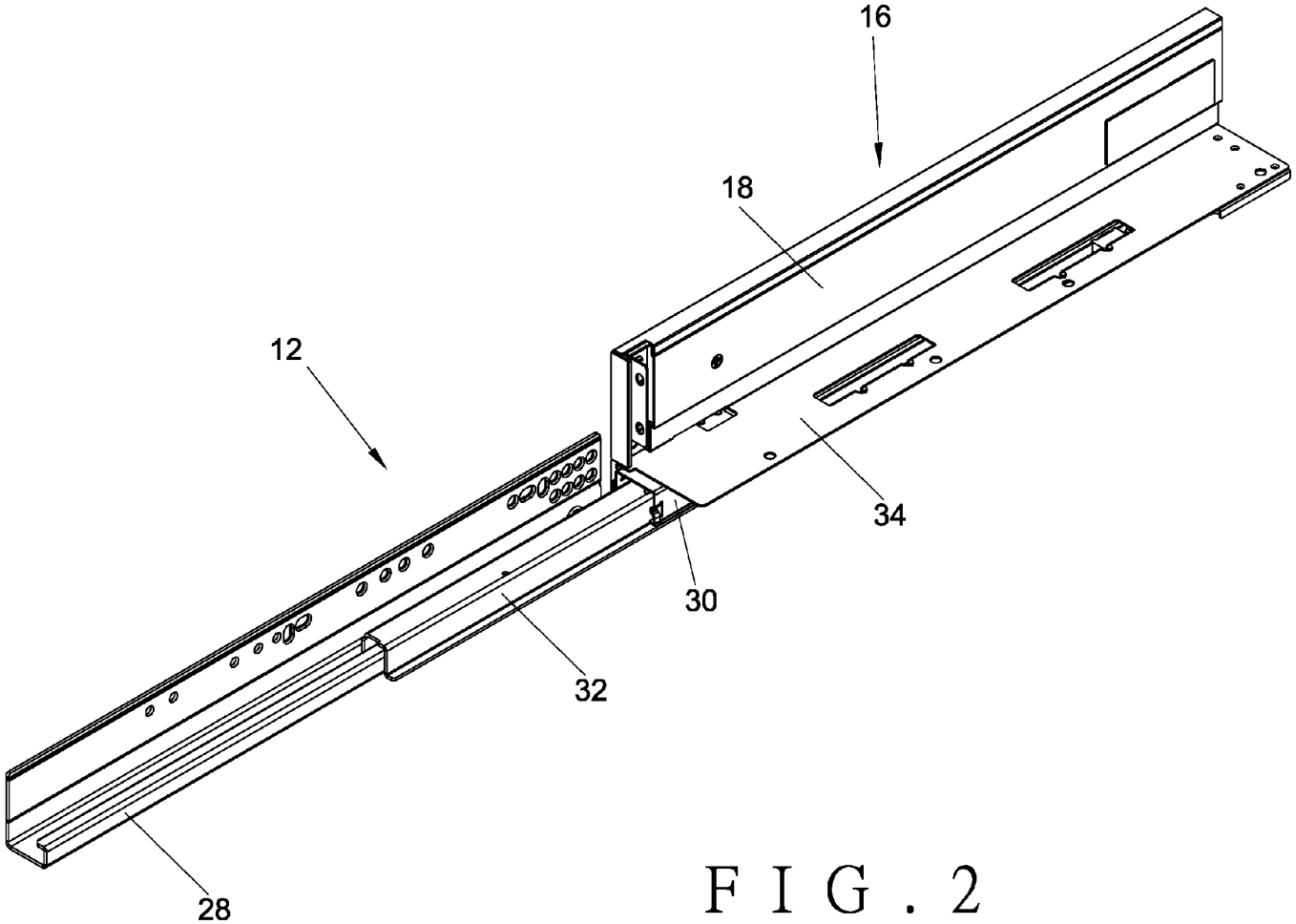
FIG. 2 is a perspective view of a drawer slide assembly in the embodiment of FIG. 1.

As shown in FIG. 2, the slide assembly 12 includes a first rail 28 and a second rail 30 which can be longitudinally displaced with respect to the first rail 28. Preferably, the slide assembly 12 further includes a third rail 32 movably connected between the first rail 28 and the second rail 30, wherein the third rail 32 allows the second rail 30 to be pulled farther with respect to the first rail 28. The drawer frame member 16 further includes a carrier 34 connected to the drawer sidewall 18 and is mounted to the second rail 30 via the carrier 34.

Figure 3:
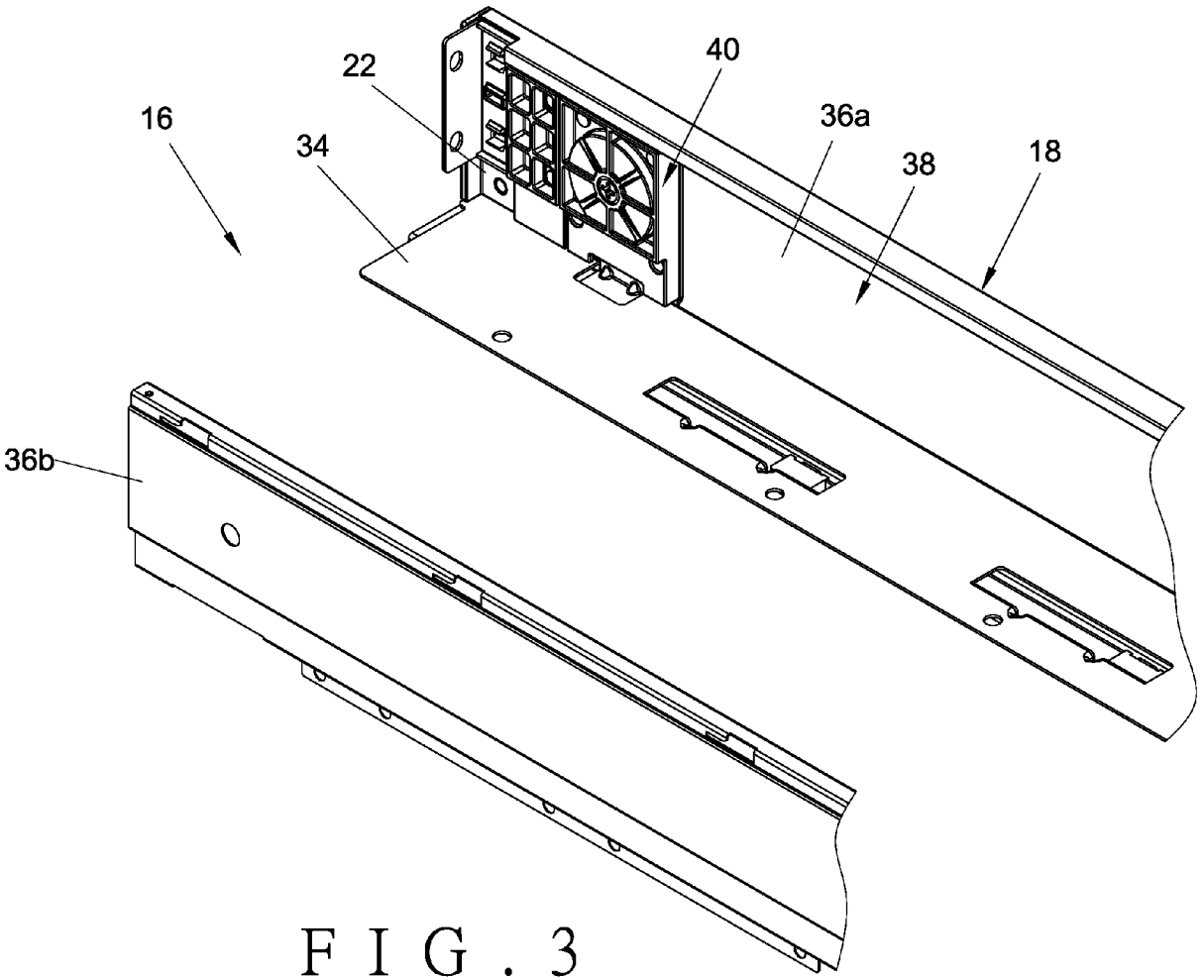
FIG. 3 is an exploded perspective view showing how the adjusting device of the drawer slide assembly in FIG. 2 is mounted to the corresponding drawer frame member.

Referring to FIG. 3, the drawer sidewall 18 includes two plates 36*a* and 36*b*, which define a receiving space 38 therebetween. The slide assembly 12 further includes an adjusting device 40 located in the receiving space 38 of the drawer sidewall 18. The adjusting device 40 is adjacent to the rear end portion 22 of the drawer sidewall 18.

Figure 4:
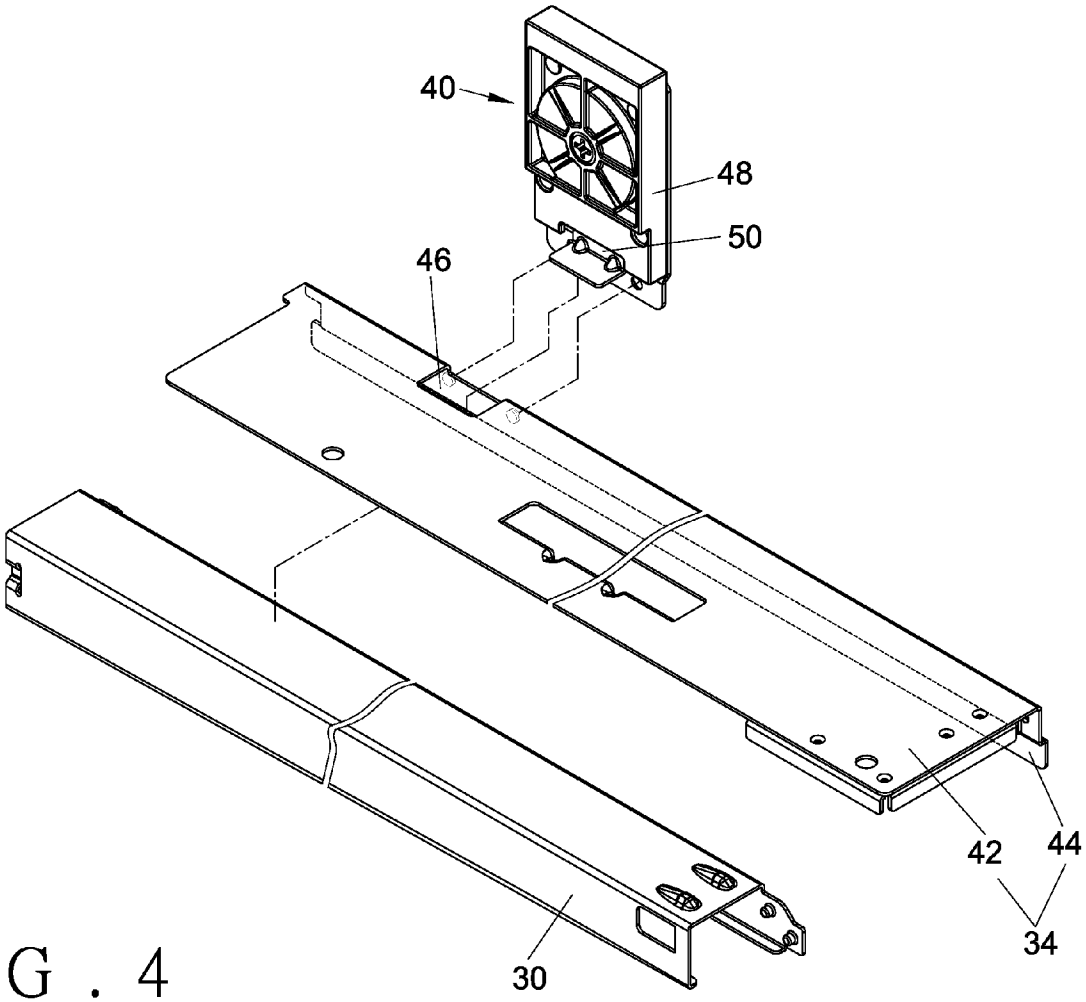
FIG. 4 is another exploded perspective view showing how the adjusting device of the drawer slide assembly in FIG. 2 is mounted to the corresponding drawer frame member.

Referring to FIG. 4, the carrier 34 includes a bottom plate 42 and a side plate 44 substantially perpendicularly connected to the bottom plate 42. The bottom plate 42 is mounted to the second rail 30 by a connecting means such as locking or mutual engagement. The bottom plate 42 is provided with an opening 46 corresponding to the second rail 30. The adjusting device 40 includes a housing 48 and a moving member 50 which can be displaced with respect to the housing 48. The housing 48 is connected to the side plate 44 of the carrier 34 by a connecting means such as riveting or threaded connection. The moving member 50 corresponds to the opening 46.

Figures 5, 5A:
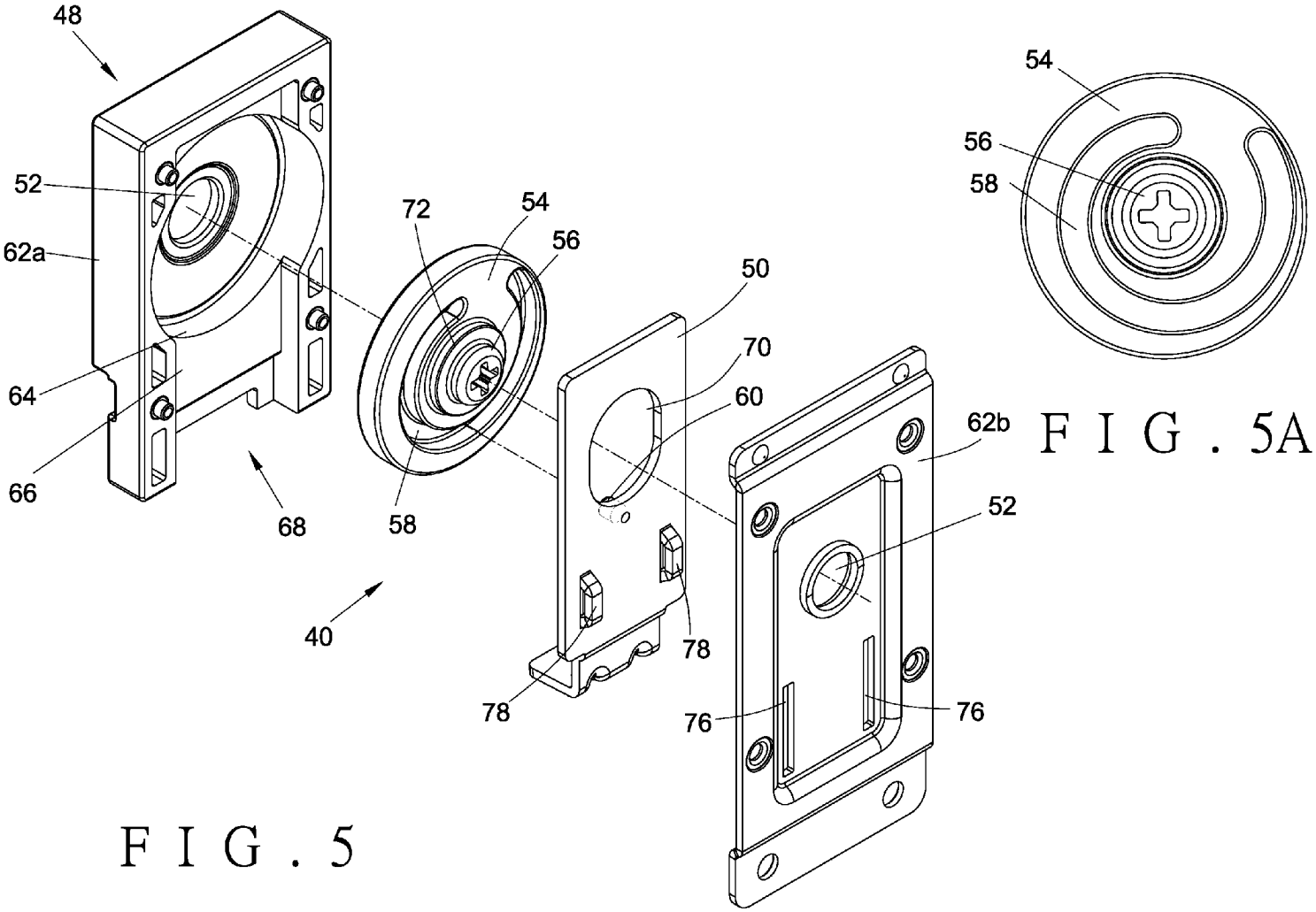
FIG. 5 is an exploded perspective view of the adjusting device in FIG. 3 and FIG. 4.
FIG. 5A is a plan view of the cam in FIG. 5.

As shown in FIG. 5 and FIG. 5A, the housing 48 of the adjusting device 40 is provided with a pivot hole 52, and the adjusting device 40 further includes a cam 54 mounted in the housing 48. The cam 54 has a shaft portion 56 pivotally provided in the pivot hole 52 of the housing 48. The cam 54 corresponds to the moving member 50. More specifically, the cam 54 has a C-shaped groove 58 formed eccentrically with respect to the shaft portion 56, and the moving member 50 has a pressing portion 60 at least partially mounted in the C-shaped groove 58. The housing 48, on the other hand, includes a first supporting base 62*a* and a second supporting base 62*b*. The first supporting base 62*a* is concavely provided with a receiving groove 64 for receiving the cam 54. The first supporting base 62*a* and the second supporting base 62*b* jointly define a moving space 66 and a passage 68 therebetween, wherein the passage 68 is in communication with the moving space 66. The moving member 50 is located in the moving space 66 and corresponds to the passage 68. Preferably, the moving member 50 has a position-limiting groove 70, and the cam 54 has a portion 72 corresponding to the position-limiting groove 70. Preferably, the second supporting base 62*b* is formed with a pair of guide grooves 76 while the moving member 50 has a pair of guiding portions 78. The pair of guiding portions 78 extend through the guide grooves 76 of the second supporting base 62*b* respectively so that the moving member 50 can be guided by the guide grooves 76 when displaced with respect to the housing 48. The guiding mechanism, however, is not limited to the foregoing. In an embodiment which is not shown, the pair of guiding portions are provided on the second supporting base instead, and the pair of guide grooves, in the moving member. Alternatively, each of the moving member and the second supporting base has a guiding portion and a guide groove, and the guiding portion and the guide groove of the moving member correspond to the guide groove and the guiding portion of the second supporting base respectively. In either case, the main purpose of the guiding mechanism is to enable guided displacement of the moving member.

Figure 7:
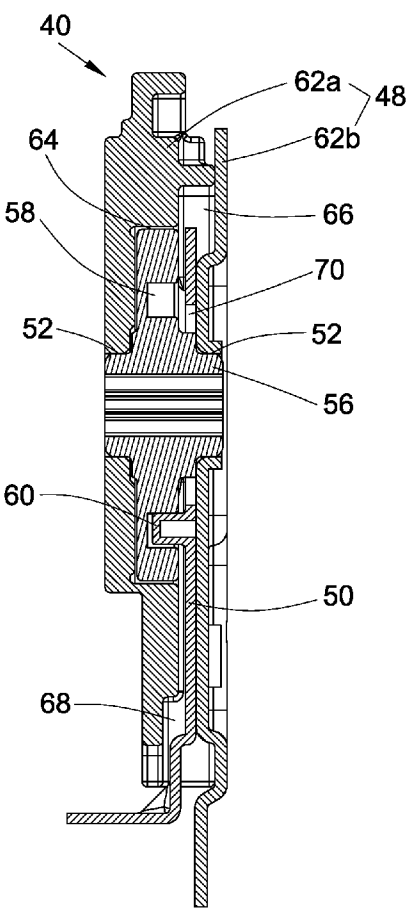
FIG. 7 is a sectional view of the adjusting device in FIG. 6.
Figure 6:
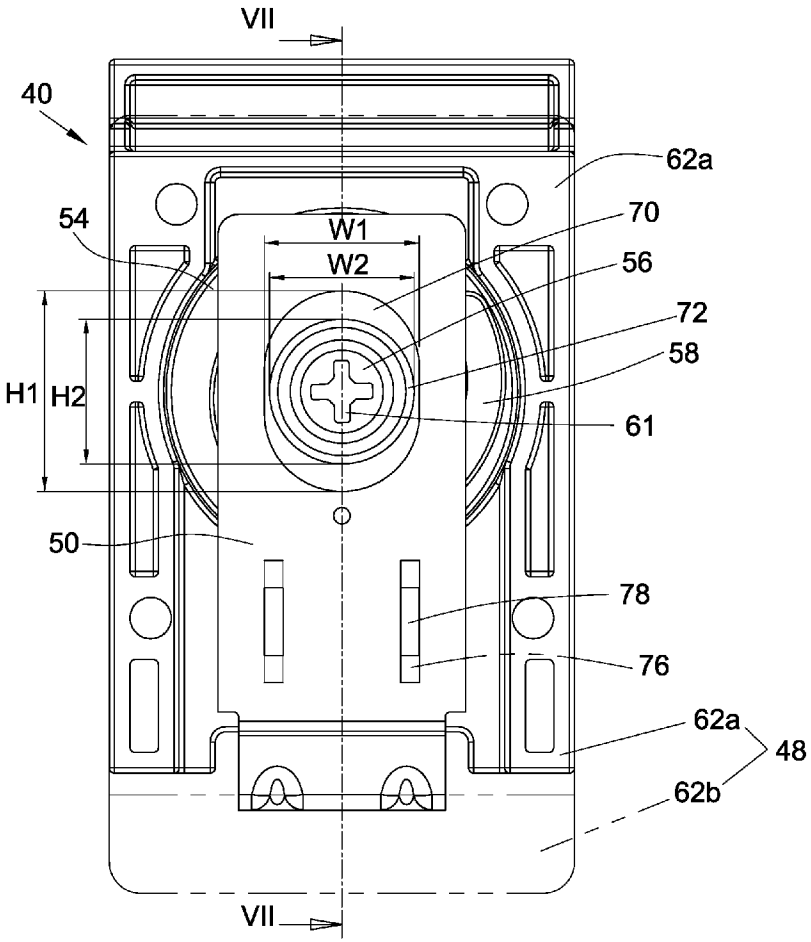
FIG. 6 is a plan view of the adjusting device in FIG. 5.

Referring to FIG. 6 and FIG. 7, a width W1 is defined as the distance between the two lateral sides of the position-limiting groove 70 of the moving member 50, and a height H1, as the distance between the upper and lower ends of the position-limiting groove 70. The portion 72 of the cam 54 is located in the position-limiting groove 70 and has a width W2 and a height H2. The width W2 is substantially equal to the width W1, but the height H2 is less than the height H1.

Figure 9:
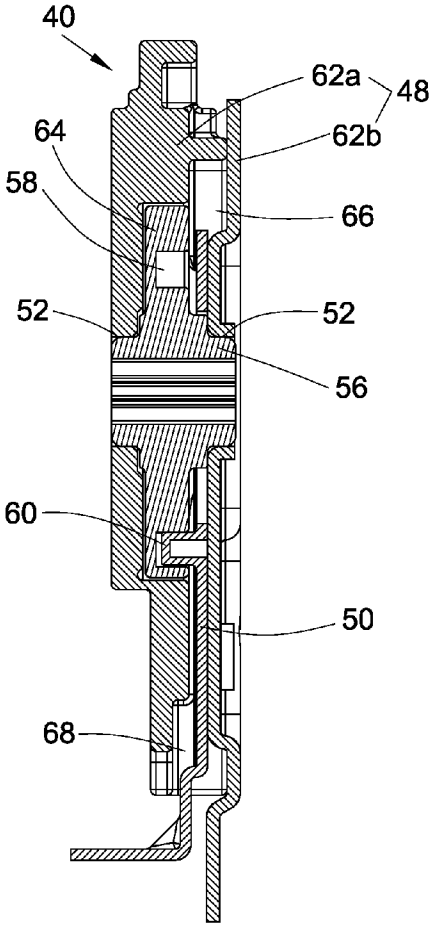
FIG. 9 is a sectional view of the adjusting device in FIG. 8.
Figure 8:
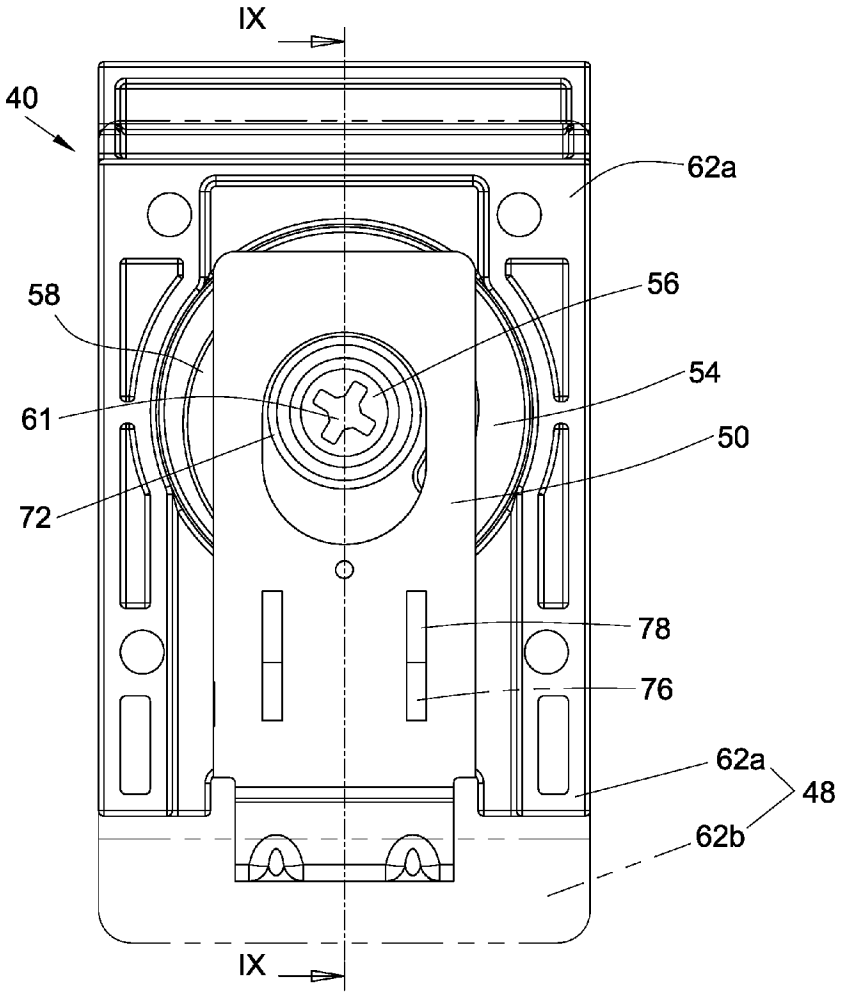
FIG. 8 is another plan view of the adjusting device in FIG. 5, and yet the cam of the adjusting device has been rotated by angle.

Referring to FIG. 8 and FIG. 9, in the course in which the cam 54 is rotated by an angle, the moving member 50 is pushed by the cam 54 and thus displaced upward or downward with respect to the housing 48. In other words, as the cam 54 rotates, the moving member 50 is linearly displaced with respect to the housing 48 along the position-limiting groove 70. Preferably, the shaft portion 56 of the cam 54 has a tool portion 61, such as an engaging groove, for insertion by a corresponding tool, such as a screwdriver, so that the cam 54 can be rotated with the tool conveniently.

Figure 10:
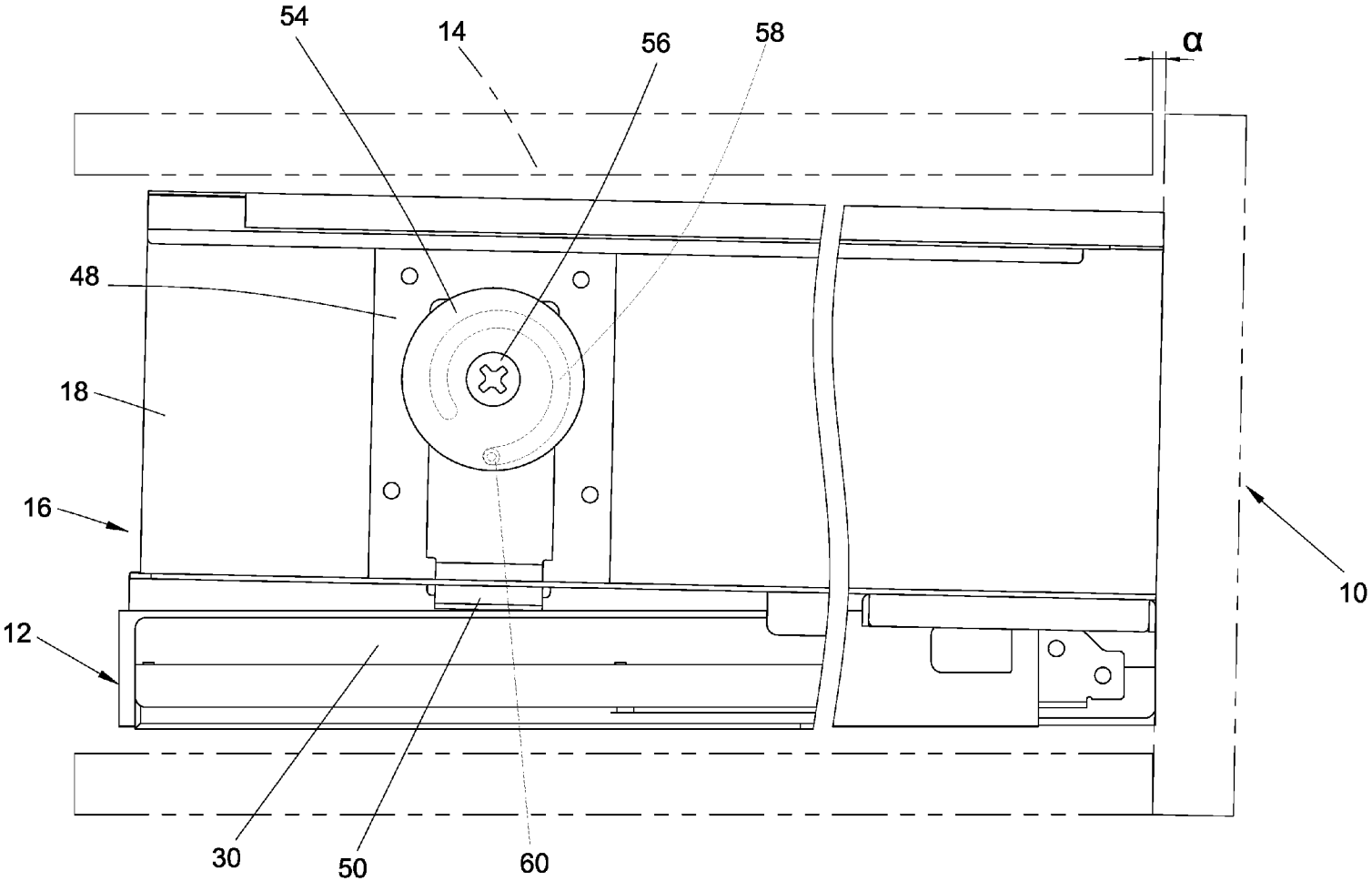
FIG. 10 is a side view showing the drawer in FIG. 1 tilted by an angle $\alpha$ with respect to the cabinet.
Figure 11:
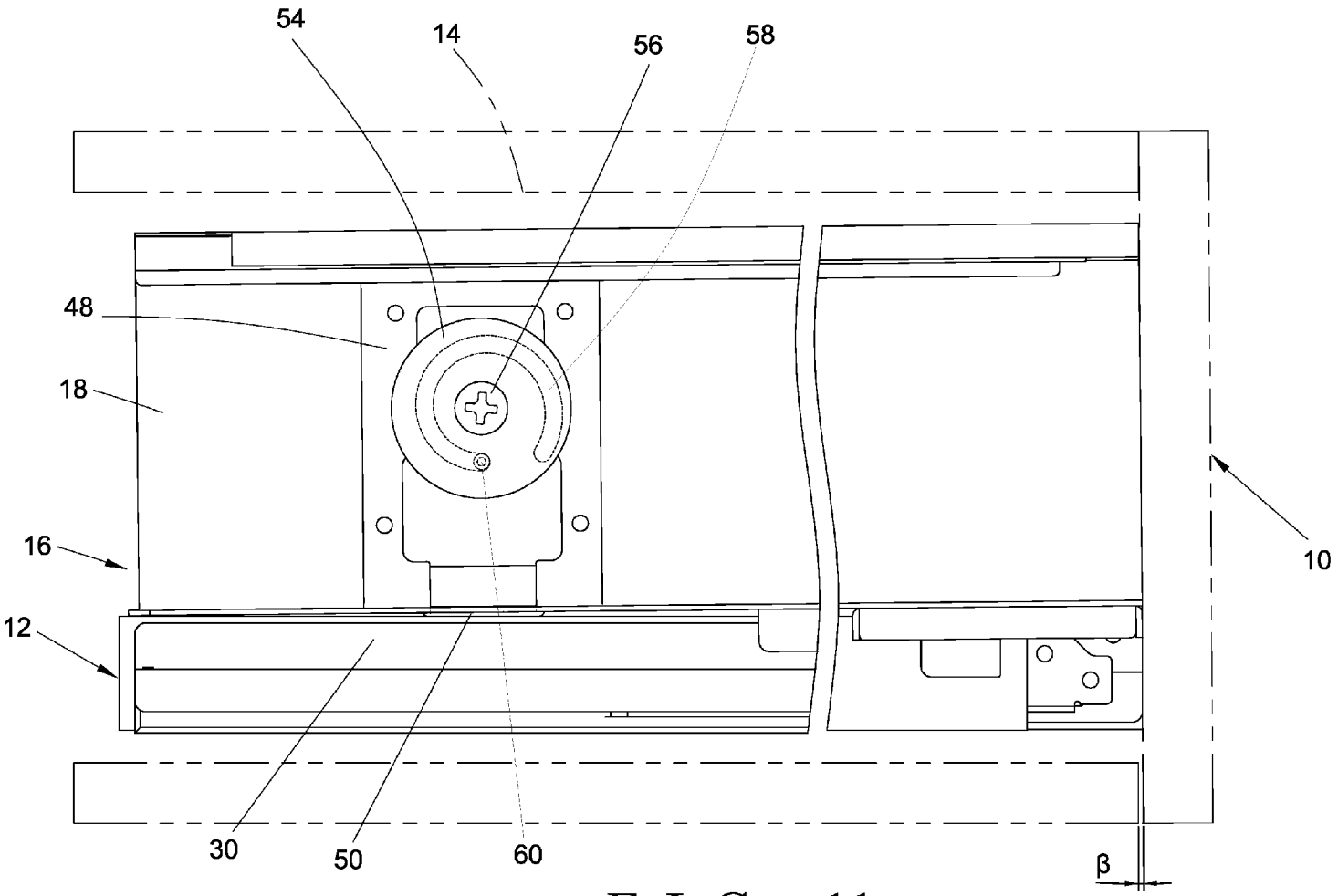
FIG. 11 is a side view showing the drawer in FIG. 1 tilted by an angle $\beta$ with respect to the cabinet.
Figure 12:
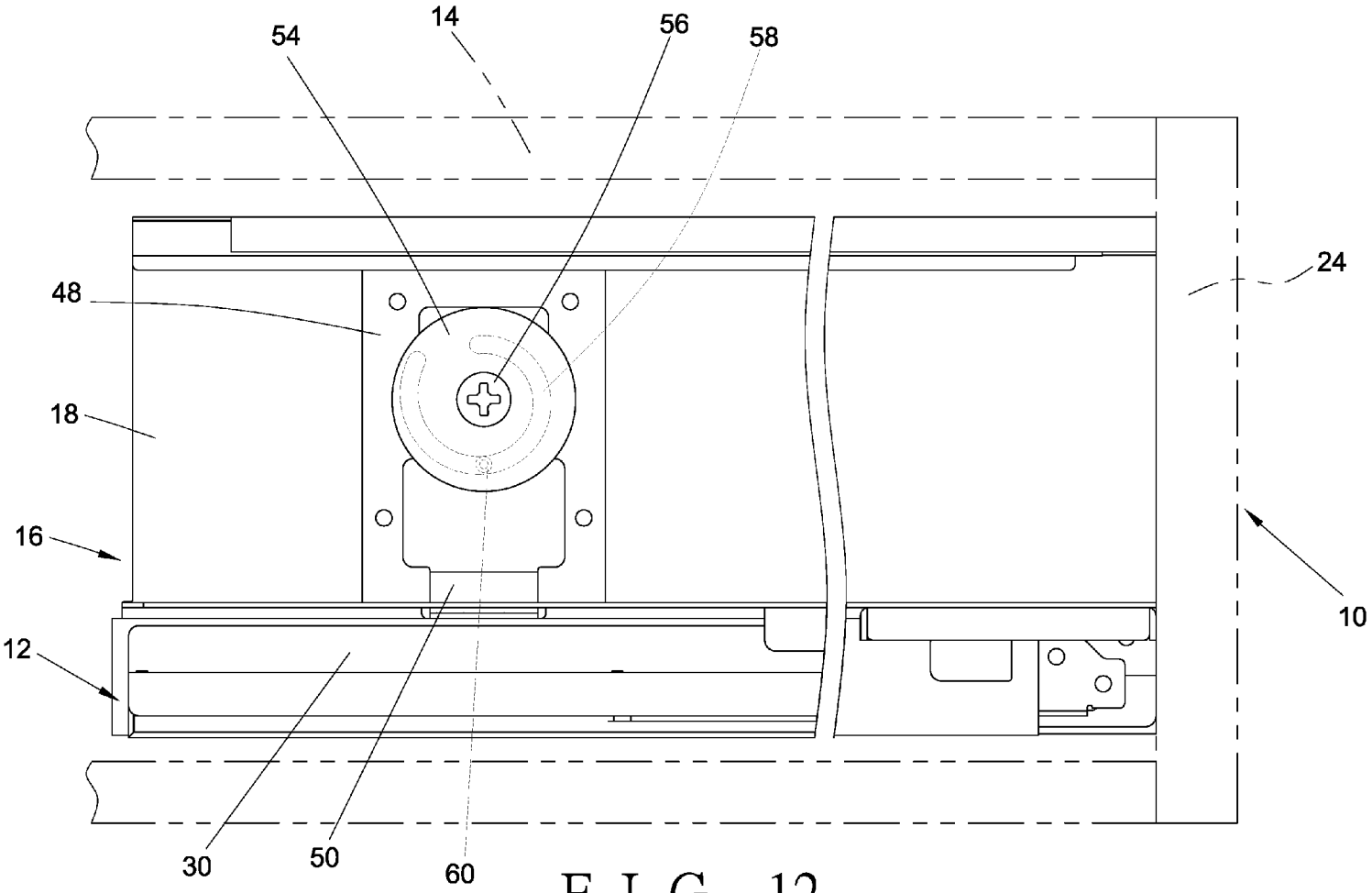
FIG. 12 is a side view showing the drawer in FIG. 10 or FIG. 11 in flush alignment with the cabinet after adjustment via the adjusting device.

Referring to FIG. 10 and FIG. 11, if the drawer 10 has an excessive assembly tolerance with respect to the cabinet 14 (e.g., the drawer 10 is allowed to tilt by an angle $\alpha$ or $\beta$ with respect to the cabinet 14 during assembly), the assembler can rotate the shaft portion 56 of the cam 54 with a tool, thereby pressing the moving member 50 against the second rail 30 of the slide assembly 12 and displacing the moving member 50 linearly with respect to the housing 48, in order for the housing 48 to move the drawer frame member 16 and thus correct the angle of the drawer 10 with respect to the cabinet 14, the objective being to bring the front panel 24 of the drawer 10 into flush alignment with the cabinet 14, as shown in FIG. 12. This adjustment is especially helpful when a plurality of drawers 10 vertically arranged in the cabinet 14 are not equally spaced from each other or are not positioned at the desired angle.

While the present invention has been disclosed by way of the preferred embodiment described above, the embodiment is not intended to be restrictive of the scope of the invention. The scope of patent protection sought by the applicant is defined by the appended claims.

What is claimed is:

1. A drawer slide assembly, comprising:

a first rail;

a second rail longitudinally displaceable with respect to the first rail;

a drawer frame member including a carrier and a drawer sidewall connected to the carrier, wherein the carrier is mounted on the second rail; and an adjusting device mounted on the drawer sidewall and configured to adjust the drawer frame member vertically with respect to the second rail, the adjusting device including:

a housing;

a cam having an intermediate body portion and a shaft portion projecting axially therefrom to define opposed first and second ends pivotally coupled to the housing at opposed sides of the intermediate body;

a moving member coupled to displace with respect to the housing responsive to actuation of the cam, wherein the moving member is extended with a guiding portion, the housing is formed with a guide groove, and the guiding portion extends through the guide groove such that the moving member is guided by the guide groove when displaced with respect to the housing.

2. The drawer slide assembly of claim 1, wherein the carrier is provided with an opening corresponding to the second rail, the moving member of the adjusting device has a portion extending through the opening in order to be pressed against the second rail.

3. The drawer slide assembly of claim 1, wherein the housing of the adjusting device is mounted on the drawer sidewall; the moving member has a pressing portion; and at least a portion of the cam is pressed against the pressing portion of the moving member such that, by rotating the cam, the moving member is displaced with respect to the housing.

4. The drawer slide assembly of claim 3, wherein the cam has a C-shaped groove, and at least a portion of the pressing portion extends into the C-shaped groove.

5. The drawer slide assembly of claim 3, wherein the housing includes two supporting bases, each of the two supporting bases has a pivot hole, and the shaft portion pivotally provided in the pivot holes of the two supporting bases.

6. The drawer slide assembly of claim 5, wherein the shaft portion of the cam has an engaging groove into which a corresponding tool can be inserted in order to rotate the cam.

7. The drawer slide assembly of claim 1, wherein the drawer sidewall includes a front end portion and a rear end portion, and the adjusting device is mounted on the drawer sidewall at a position adjacent to the rear end portion of the drawer sidewall.

8. The drawer slide assembly of claim 1, wherein the drawer sidewall includes two plates, the two plates define a receiving space therebetween, and the adjusting device is located in the receiving space.

9. A drawer slide assembly, comprising:

a first rail;

a second rail longitudinally displaceable with respect to the first rail;

a drawer frame member including a carrier and a drawer sidewall connected to the carrier, wherein the carrier is mounted on the second rail, the drawer sidewall includes a front end portion and a rear end portion, the front end portion is connected to a front panel, and the rear end portion is connected to a rear panel; and an adjusting device mounted on the drawer sidewall at a position adjacent to the rear end portion of the drawer sidewall, the adjusting device being configured to adjust the drawer frame member vertically with respect to the second rail, the adjusting device including:

a housing;

a cam having an intermediate body portion and a shaft portion projecting axially therefrom to define opposed first and second ends pivotally coupled to the housing at opposed sides of the intermediate body;

a moving member coupled to displace with respect to the housing responsive to actuation of the cam, wherein the moving member is extended with a guiding portion, the housing is formed with a guide groove, and the guiding portion extends through the guide groove such that the moving member is guided by the guide groove when displaced with respect to the housing.

10. The drawer slide assembly of claim 9, wherein the carrier of the drawer frame member is provided with an opening corresponding to the second rail, the moving member of the adjusting device has a portion extending through the opening in order to be pressed against the second rail.

11. The drawer slide assembly of claim 9, wherein the adjusting device includes: the housing being mounted on the drawer sidewall; the moving member having a pressing portion; and at least a portion of the cam being pressed against the pressing portion of the moving member such that, by rotating the cam, the moving member is displaced with respect to the housing.

12. The drawer slide assembly of claim 11, wherein the cam has a C-shaped groove, and at least a portion of the pressing portion extends into the C-shaped groove.

13. The drawer slide assembly of claim 11, wherein the housing includes two supporting bases, each of the two supporting bases has a pivot hole, and the shaft portion pivotally provided in the pivot holes of the two supporting bases.

14. The drawer slide assembly of claim 13, wherein the shaft portion of the cam has an engaging groove into which a corresponding tool can be inserted in order to rotate the cam.

15. An adjusting device applicable to furniture, comprising:

a housing including two supporting bases, wherein each of the two supporting bases has a pivot hole;

a moving member displaceable with respect to the housing, the moving member having a pressing portion; and a cam having an intermediate body portion and a shaft portion projecting axially therefrom to define opposed first and second ends pivotally coupled to the pivot holes of the two supporting bases at opposed sides of the intermediate body, wherein at least a portion of the cam is pressed against the pressing portion of the moving member such that, by rotating the cam, the moving member is responsively displaced with respect to the housing, wherein the moving member is extended with a guiding portion, the housing is formed with a guide groove, and the guiding portion extends through the guide groove such that the moving member is guided by the guide groove when displaced with respect to the housing.

* * * * *